United States Patent [19]

Toulson

[11] Patent Number: 4,744,874

[45] Date of Patent: May 17, 1988

[54] TREATMENT OF MEDIUM USED IN PHOTOGRAPHIC PROCESSORS

[75] Inventor: Brian Toulson, Leeds, England

[73] Assignee: Fixersave Limited, Leeds, England

[21] Appl. No.: 21,261

[22] Filed: Mar. 3, 1987

[30] Foreign Application Priority Data

Mar. 4, 1986 [GB] United Kingdom ..... 8605278

[51] Int. Cl.[4] ..... C25C 1/20

[52] U.S. Cl. ..... 204/109; 204/228; 204/237; 204/277

[58] Field of Search ..... 204/109–111, 204/237, 258, 228, 265, 277, 278

[56] References Cited

U.S. PATENT DOCUMENTS

| | | | |
|---|---|---|---|
| 1,345,846 | 7/1920 | Greenawalt | 204/265 |
| 1,954,316 | 4/1934 | Hickman et al. | 204/109 |
| 3,003,942 | 10/1961 | Cedrone | 204/109 |
| 4,128,464 | 12/1978 | Idota | 204/151 |
| 4,139,431 | 2/1979 | Scheidegger et al. | 204/109 |
| 4,212,722 | 7/1980 | Avedesian et al. | 204/265 |

FOREIGN PATENT DOCUMENTS

| | | | |
|---|---|---|---|
| 2160546A | 12/1985 | United Kingdom | 204/109 |

OTHER PUBLICATIONS

Kaufmann, R., and Mohier, F., "Method for Electrolytically Recovering Metal Dissolved in an Electrolyte," Research Disclosure, Feb. 1981, No. 20212 Havant Hampshire, Great Britain, pp. 88–89.

*Primary Examiner*—R. L. Andrews

*Attorney, Agent, or Firm*—David A. Jackson; Richard M. Goldberg; Barbara L. Renda

[57] ABSTRACT

The invention provides an electrolyte cell which is used for the electrodeposition of silver from a fixer medium (used as the electrolyte) which has previously been used and has to be re-used for developing photographic films, X-ray plates and the like processes wherein silver is extruded by the treatment process. While the silver electrodeposition is taking place, air is bubbled through the electrolyte to prevent copper sulfate and the additives in the electrolyte from settling out and aggregating which shortens the life of the fixer medium. The electric potential which is applied to the electrodes is such as to give a much smaller electrolyzing current i.e. up to 1 amp compared to the more usual electrolyzing currents of 10 amp or more.

5 Claims, 2 Drawing Sheets

TREATMENT OF MEDIUM USED IN PHOTOGRAPHIC PROCESSORS

This invention relates to photographic processing, and in particular concerns an invention which will result in economisation of the chemicals which are used in, photographic processing.

The present invention applies to the photographic processing of various forms of photographic plates and films such as the graphic art film, offset, gravure, phototypesetting and X-ray plates as used in medical and industrial applications where the developed photographi is black and white in nature, as distinguished from the ordinary colour photographic film as used in hand held cameras.

In the processing of such plates and films, liquids are used in the processing apparatus, such chemicals including developer, fixer, and water.

The most expensive of these liquids is the chemical which is used for the fixing of the images, and this chemical in being brought into contact with a plate or film containing a concealed image extracts the silver from the plate or film in order to make the image visible and permanently to fix the image. Additionally, however the fixer extracts copper sulphate and various other additives (which are contaminants) which are in the film or plate, with the result that the fixer to some extent becomes contaminated and partially has to be discarded.

Normally, the photographic processing involves three stages or units. A first unit contains the developer through which the plate or film is passed. The second unit contains the fixer through which the film or plate is passed and the third unit contains water through which the film or plate is passed.

From the second unit, the fixer after use is passed to a silver extracting cell which is an electrolytic cell containing a cathode and an anode between which potential is applied, and the current which flows between the anode and cathode causes electrostatic deposition of the silver contained in the mixture to be deposited on the cathode. The cathode and anode are in fact rotated whilst immersed in the fixer but the remaining liquid after the silver deposition is in fact discarded as it still contains the copper sulphate and other additives. The potential which is applied across the anode and cathode is such as to give a current flow between the anode and cathode of the order of 10 amps, and this high current furthermore has a chemical effect on the fixer which in fact destroys its properties and therefore apart from the chemical contamination caused by the copper sulphate and other additives, the utility of the fixer is destroyed. The used water from the third unit is discarded.

This of course represents an expensive use of the fixer and the present invention seeks to provide a method and apparatus whereby a more economic use of the fixing medium can be achieved.

According to the invention, the fixer after emerging from the processing related unit is treated and is recycled back to the related processing unit, and in the treatment of the fixer (or water) after it has been used for the fixing of photographic films and plates, it is subjected to an aeration treatment thereby to generate a profusion of bubbles in the medium which disperses the copper sulphate and other additives.

By this means, and by a specific construction and method, it has been found that at least the fixer can be recycled several times, which represents a saving in the fixer material. Traces of silver can be recovered from the water.

The saving or fixer medium arises in this way. Normally, in the known method the processor has to be replenished with fresh fixer at a certain frequency dictated by the capacity of the processing plant. By using the treatment method according to the invention, it has been found that the replenishment frequency is considerably reduced.

In a specific embodiment, the fixer after it has passed through the fixer unit is passed to a treatment tank, and in the treatment tank is contained an electrolytic cell comprising a closed chamber but having apertures in the wall thereof and through which the fixer can pass, and inside the chamber are anode and cathode electrodes for effecting electrolyte treatment of the fixer to remove small amounts of silver therefrom. Additionally, an air supply is connected to the chamber interior so that air can be bubbled into the base of the chamber to give said aeration effect. The air bubbles out of those of said apertures located at the top of the chamber. The electrolyte treatment is conducted at much lower amperages than is conventional in order not to destroy the chemical utility of the fixer.

The chamber may be defined by a container having a lid which is in fact removable, but normally it will be connected to the body of the container by means of a tamperproof connection.

The cathode may comprise a V-section plate of stainless steel, whilst the anode typically will be a block of carbon.

The electrolytic cell is preferably run at an amperage of up to no more than 300 mA and the cell may be served by a control box by which the cell can be run at any of several different amperages, for example four different amperages ranging from up to 300 mA the cell being set to operate at a particular amperage as dictated by the positioning of a multi-position switch on the control box. The control box may also contain the prime mover which supplies the air for the aeration aspect of the process. The prime mover may comprise a small air pump driven by an electric motor inside the control box.

The chamber size and the size of the apertures on the wall through which the liquid and aerating medium can pass will be controlled to give maximum operational efficiency.

The silver which collects on the cathode may be extracted by conventional means and in a conventional method.

It is appreciated that the fixer will eventually become so saturated with silver, copper sulphate and other additives that it will have to be passed to the silver recovery unit and then discarded, but by the method and means of the present invention, the time when it is discarded can be much later than the conventional method.

The apparatus can also be used for recovery of the small amounts of silver which are carried over by the plates and film from the second unit into the third washing unit by passing the water to a water treatment tank provided with one of the cells according to the invention. The treated water may be recycled if desired until it is too contaminated to be used further.

The advantages of the invention, at least in its preferred form, are that the fixer can be used more times without loss of quality. It is not necessary to adjust the processor in any way. There is less downtime of the processor. More silver is recovered and there is less toxic effluent per unit time located..

BRIEF DESCRIPTION OF THE DRAWING

The principles of operation of the invention are contained in the embodiment of the invention illustrated in the accompanying drawings, wherein.

DETAILED DESCRIPTION OF THE INVENTION

Figure 1:
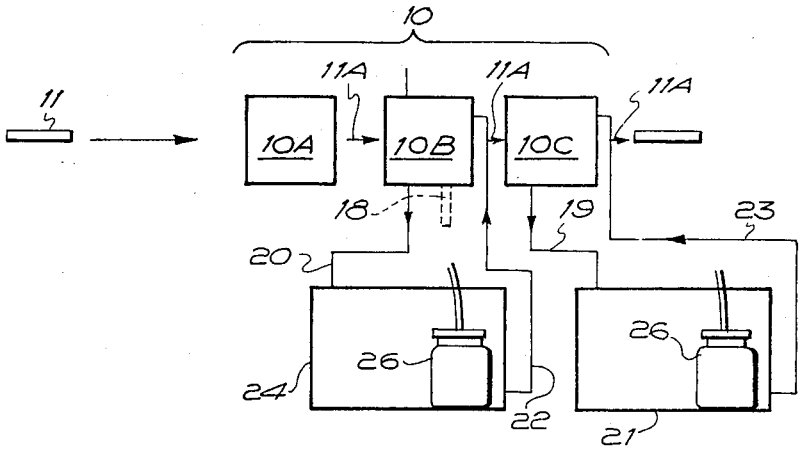
FIG. 1 is a diagrammatic view of a photographic film or plate processing system operating according to the method of the invention.

Referring to the drawings, in FIG. 1 numeral 10 represents a conventional photographic film or plate process comprising three processing units 10A, 10B and 10C containing developer, fixer and water respectively and in turn through which photographic film or plates 11 are passed in order to develop the images on the film or plates. The fixer is introduced into unit 10B by means of pipe 12 and the path of movement of the plates or film 11, is indicated by numeral 11*a*.

In conventional arrangements, when the fixer in processor unit 10B has reached the stage where it is no longer usable (which may be after one use only), because of the silver concentration therein and the contamination by copper sulphate and other additives it is normally discharged through outlet 18 to a silver recovery unit (not shown) of conventional form to recover silver therefrom. The residual liquor from the silver recovery unit is discharged to drain.

The rate of utilisation of the fixer is determined by the frequency at which the user fixer has to be discharged through outlet 18. The present invention provides a means whereby the said discharge and replenishment rate can be reduced or in other words the fixer solution in the processor 10 can be used for a longer period.

This is achieved by recycling the solution from the processor 10 through the recycle pipes 20 and 22. The liquid drawn from the processor 10 is passed through pipe 20 into a treatment tank 24, and from the treatment tank 24 the liquid is drawn through pipe 22 and returned to the processor 10.

The treatment tank contains immersed therein a treatment cell 26 which is powered from a control box 28 (FIG. 2) as will be described in relation to FIGS. 2 or 3.

Similarly, the water from the unit 10C can be drawn through pipe 19 and delivered to a water tank 21 containing another of said cells 26 for the recovery of residual silver in the water which is carried over by the plates and film from the unit 10B. The water may be re-cycled from tank 21 through pipe 23, or it may be discharged as required.

The treatment cell 26 as regards the fixer medium at least serves two purposes. On the one hand it serves to effect electrolytic deposition of a small amount of the silver contained in the circulating liquid, and it more importantly aerates that liquid in order to keep the copper sulphate and other additives dispersed evenly through the liquid to prevent aggregation and setting out of same and also to liberate small amounts of silver which deposit on the cell electrodes. The cell 26 is not intended however to be a silver recovery unit and is run at such a low amperage as not to chemically effect the fixer liquid or to chemically effect the liquid as little as possible.

Figure 3:
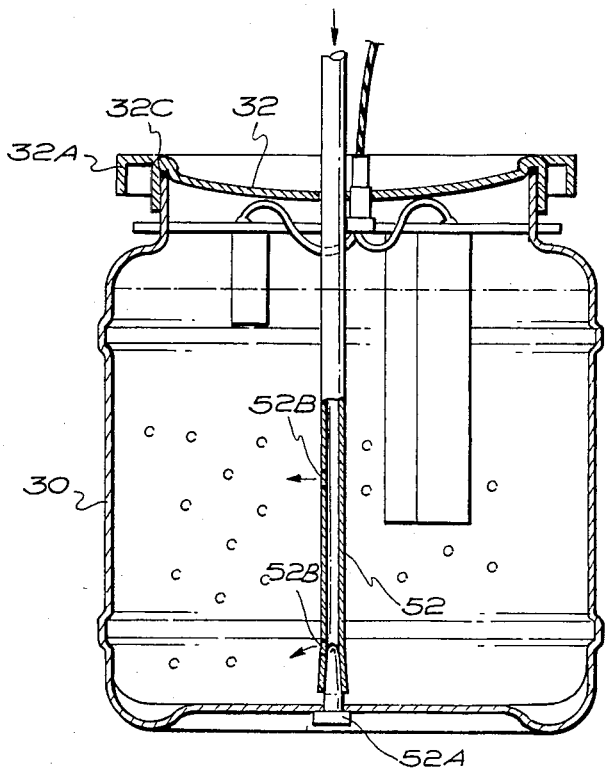
FIG. 3 is a sectional elevation illustrating the electrolyte cell shown in FIG. 2.
Figure 2:
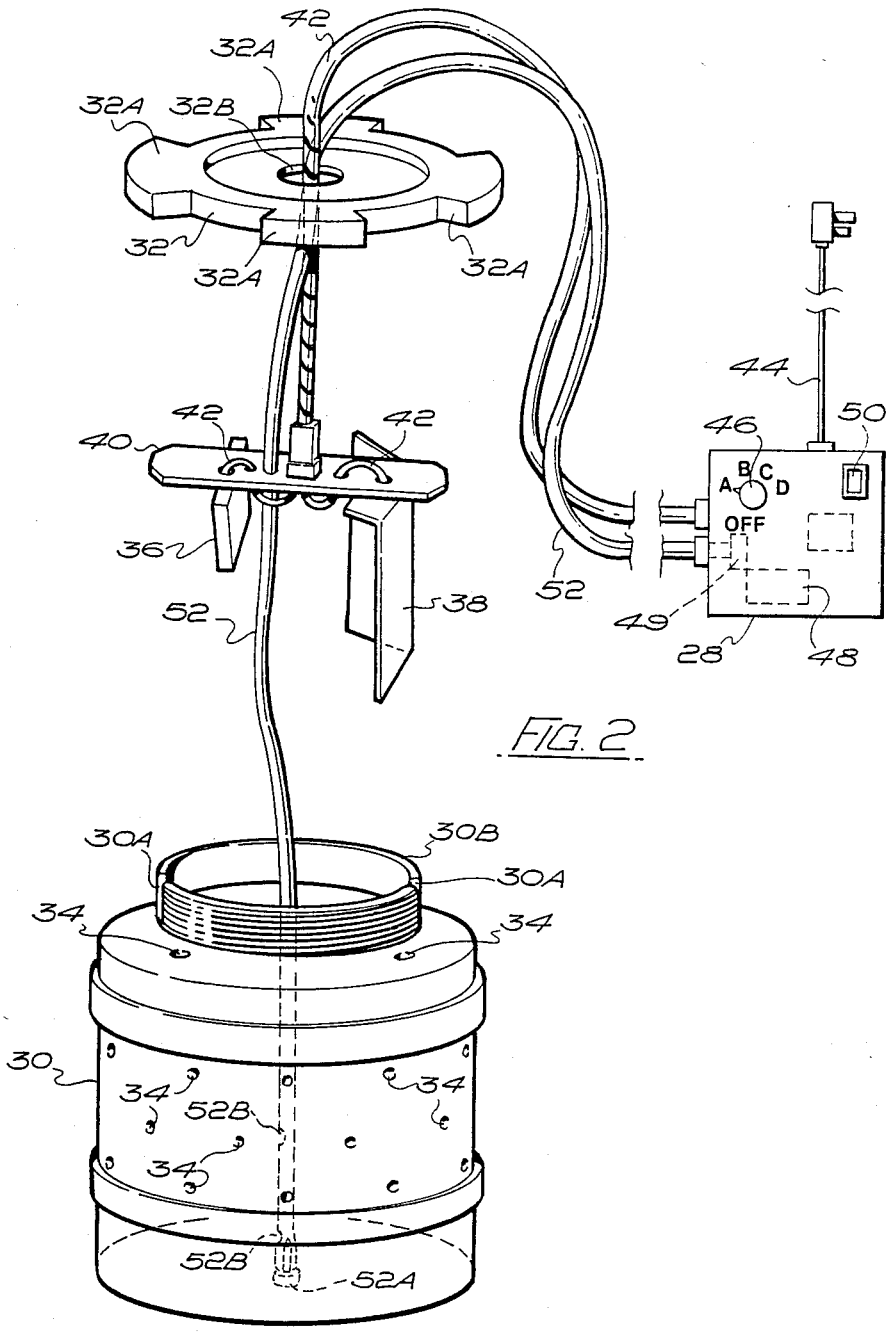
FIG. 2 is an exploded perspective view illustrating the electrolyte cell and control box according to the invention.

The cell and control box are shown in FIGS. 2 and 3, and it will be seen that the cell comprises a body 30 closeable by means of a screw cap 32 having turning wings 32A and a central aperture 32B so that the cell is closed, and there may be a tamperproof device coupling cap 32 and body 30 to prevent unauthorised moving of the cap without it being obvious that it has been tampered with. Inside the cap 32 is a rubber sealing ring 32C which seals the top of body 30 when the cap is applied thereto.

The cell body 30 is provided with a series of apertures 34 through which the surrounding circulated liquid can pass, and out of the top ones of which aerating medium can escape, and inside the cell is a pair of electrodes 36 and 38 being a carbon block anode 36 and a stainless steel plate cathode 38. These are supported by a rigid plate 40 and are electrically insulated in relation thereto. The electrical power to the electrodes is supplied through lines 42 (which pass through apertures 32B and in cap 32) from the control box 28, the control box in turn receiving its power from an input mains line 44. The control box is provided with an on/off switch 50 a setting switch 46 controlling the voltage across lines 42, and hence the amperage through from the electrodes 36 and 38, and an ammeter 51 for reading the electrolising current flowing between the electrodes 36, 38. The electrical circuitry in the control box 28 is connected to the standard mains 250 volts/50 cycles per second supply to ensure that only a small current is drawn through lines 42 for example, up to a maximum of 300 mA (milliamperes).

Typically, the four settings A, B, C and D as shown for the control switch 46 correspond to amperages ranging in even steps up to 300 mA, between the electrodes 36 and 38. By using such low amperages, there is no chemical destruction of the fixer material, which would render same unusable.

The plate 40 is held in position in relation to body 30 by providing cut outs 30A in the threaded neck 30B of body 30 so that the plate is recessed or cut into as shown in FIG. 3 and when the cap 32 is secured to neck 30B the plate 40 is then trapped in the position shown in FIG. 3 in which the electrodes 36, 38 hang down into the interior of body 30.

The control box 28 houses a small electric motor 48 which is electrically driven to drive an air pump 49 when the control box on/off switch 50 is positioned to the "on" position. Pump 49 supplies a stream of aerating medium, in this case air through a delivery pipe 52 which extends through the aperture 32B, through the plate 40 and is threaded into a screw 52A which passes through the base of the body 30 as shown. The ppe 52 has apertures 52B in the wall thereof out of which the air bubbles when the cell is in use. The pipe 52 is a plastics material pipe of 3 mm inside diameter.

The air bubbles out of the aperture 52B of the pipe 52 to inside the cell as shown in FIG. 3, and because the pipe 52 is narrow, in fact very many tiny bubbles emerge into and pass through the liquid, and this ensures an even dispersion of the copper sulphate and other additives throughout the liquid, making useful the life of the liquid so much greater. Whilst the current flows from the electrodes 36 and 38, silver is deposited on the cathode and subsequently can be recovered. The apparatus can be operated so that only the air flows, if it is not required to have the simultaneous electrodeposition of silver, on the cathode.

The cell and the connections 52 and 42 thereto may be arranged to be tight plug-in connections with the box 28, so that when the cell is saturated in that the electrode 38 cannot hold any further silver, the cell can be removed and replaced easily by a replacement cell of a similar type, and the removed cell can be processed to extract the silver.

A typical cell may comprise a body 30 of diameter 200 mm and length 300 mm, air being supplied to the interior of the cell at a rate of 1.5 liters/min at a 1.4 meters head during such operations as much as 150 liters of fixer can be processed over 36 hours to recover 0.50 grams/liter of silver. There may be a range of differently sized cells for handling different volumes of fixer.

It has been found that in using the invention, the full life of the fixer in the liquid can be increased four or more times, and clearly this represents a considerable financial saving as regards costs for the fixer material. The invention can also be used for recovering silver from the washing unit 10B.

Silver recovery and/or treatment can take place continuously, i.e. whether or not plates are being processed in the unit 10 as a stage treatment. That is to say, in the stage treatment the fixer may be treated in cell 30 over a period of time when no plates or films are being processed in processor 10 to regenerate the fixer and then at the end of the treatment of the fixer in cell 30, the film is returned to the plate/film in processor 10, and when the film/plate processing is complete, the liquid medium is again returned to cell 30 for regeneration of same, but in any event the running of the plant is at the convenience of the operator.

The aeration treatment can take place without the electrolysis if required, and in this connection, the invention also includes the arrangement wherein the fixer is subjected to aeration at any suitable location or in any suitable tank, for example tank 24, in which case a separate cell 26 may not be necessary. Also the aeration and electrolysing may be carried out in sequence.

I claim:

1. A method of treating photographic fixer medium used for the development of black and white photographic films, X-ray plates and the like, to extend the useful life of the fixer medium comprising the steps of:

(a) recirculating the fixer medium between a fixer tank in which photographic negatives are subject to fixation and a conditioning treatment tank;

(b) inserting a portable treatment unit in the conditioning tank, said unit comprising:

(i) a container having apertures therein so that fixer medium can flow into and out of the container, electrodes in the container for the electro-deposition of silver from the fixer medium, air delivery means and means enabling air to be bubbled from the air delivery means into the container for the treatment of the fixer medium, (ii) a control box including an air pump and power supply, and (iii) an air pipe and coupling cables connecting the control box and said air delivery means and the said electrodes, and the treatment unit being portable for easy removal, servicing and replacement of the container, (c) supplying air to said air delivery means to cause agitation of the first medium in said container in the treatment tank; and (d) applying an electric potential to said electrodes to cause an electrolysing current of no more than 300 mA to flow between the electrodes so as to deposit on the cathode only small amounts of silver and so as not to impair the fixing quality of the fixer medium.

2. A method according to claim 1, wherein the volume of the chamber is approximately 300 sq.cm and the gas is introduced into the chamber at a rate of 1.5 liters/min.

3. A method according to claim 2, wherein the said voltage is selectively controllable.

4. A photographic film fixing installation for the development of black and white photographic films, X-ray plates and the like comprising;

(a) a fixer tank containing photographic fixer medium for the fixing of photographic films placed therein;

(b) a conditioning tank;

(c) recirculating means connecting the fixer tank and conditioning tank enabling the fixer medium to be circulated to the conditioning tank and back to the fixer tank;

(d) a treatment unit for conditioning the fixer medium so that it can be recycled to the fixer tank for re-use before finally being discharged, said unit comprising:

(i) a container placed in the treatment tank and having apertures therein so that fixer medium can flow into and out of the container, electrodes in the container for the electro-deposition of silver from the fixer medium, air delivery means and means enabling air to be bubbled from the air delivery means into the container for the treatment of the fixer medium, (ii) a control box including an air pump and power supply, and (iii) an air pipe and coupling cables connecting the control box and said air delivery means and the said electrodes, and the treatment unit being portable for easy removal, servicing and replacement of the container; and (e) said control means set to limit the current which flows between the electrodes in use to a maximum of 300 mA.

5. A method according to claim 4, wherein said electric control means includes a four position control switch for varying the D.C. potential supplied to the electrodes to give respective D.C. potential across the electrodes which give rise to currents between the anode and cathode in the range up to 300 mA.

* * * * *